US009061687B2

(12) United States Patent
Zaerr

(10) Patent No.: US 9,061,687 B2
(45) Date of Patent: Jun. 23, 2015

(54) RAILROAD CAR FOR CARRYING MOTOR VEHICLES

(71) Applicant: Gunderson LLC, Portland, OR (US)

(72) Inventor: Jon B. Zaerr, Portland, OR (US)

(73) Assignee: Gunderson LLC, Portland, OR (US)

( * ) Notice: Subject to any disclaimer, the term of this patent is extended or adjusted under 35 U.S.C. 154(b) by 185 days.

(21) Appl. No.: 13/773,978

(22) Filed: Feb. 22, 2013

(65) Prior Publication Data

US 2014/0123872 A1 May 8, 2014

Related U.S. Application Data

(60) Provisional application No. 61/722,695, filed on Nov. 5, 2012.

(51) Int. Cl.
*B61D 3/18* (2006.01)

(52) U.S. Cl.
CPC ..... *B61D 3/18* (2013.01)

(58) Field of Classification Search
CPC ..... B61D 3/18; B61D 3/02; B61D 3/04; B61D 3/187
USPC ..... 105/355, 458, 404, 370
See application file for complete search history.

(56) References Cited

U.S. PATENT DOCUMENTS

| | | | |
|---|---|---|---|
| 1,246,467 | A | 11/1917 | Rember |
| 1,965,525 | A | 7/1934 | Roscher et al. |
| 2,066,714 | A | 1/1937 | Butterworth |
| 2,137,979 | A | 11/1938 | Cooper |
| 2,164,662 | A | 7/1939 | Nampa |
| 2,294,357 | A | 8/1942 | Dean et al. |
| 2,647,009 | A | 7/1953 | Huebshman |
| 2,685,263 | A | 8/1954 | Barnes et al. |
| 3,139,371 | A | 6/1964 | Sisko |
| 3,221,669 | A | 12/1965 | Baker et al. |
| 3,230,900 | A | 1/1966 | Ruprecht et al. |

(Continued)

FOREIGN PATENT DOCUMENTS

SU 1119897 A1 10/1984

OTHER PUBLICATIONS

TTX Company, "Low Level, Wide Body, Upsill Auto Rack Car", technical drawing sheet No. 9450, Mar. 31, 1994, Chicago, Illinois.

(Continued)

*Primary Examiner* — Mark Le
(74) *Attorney, Agent, or Firm* — Chernoff Vilhauer McClung & Stenzel LLP

(57) ABSTRACT

A fully protective railroad freight car for carrying motor vehicles in a selected one of a bi-level or a tri-level configuration, with the lowest level including a depressed longitudinally central portion between body bolsters of the underbody, which may be a low-level flat car. A pair of vehicle-carrying decks are adjustable in height to provide for either one or two vehicle-carrying levels above the lowest level, while also providing at least a prescribed amount of vertical clearance above each vehicle-carrying deck. Ramps may be provided on the lowest level at an end of the car to provide a wheel-supporting surface having a prescribed minimum height. A roof structure is light in weight, and the car has an overall height not exceeding a prescribed limit for operation on most rail lines. The ends of the car are equipped with three-panel folding doors.

7 Claims, 11 Drawing Sheets

(56) References Cited

U.S. PATENT DOCUMENTS

| | | | | | |
|---|---|---|---|---|---|
| 3,370,552 | A | * | 2/1968 | De Podesta et al. | 410/10 |
| 3,405,661 | A | | 10/1968 | Erickson et al. | |
| 3,552,271 | A | | 1/1971 | Suggs et al. | |
| 3,646,627 | A | | 3/1972 | Potter | |
| 3,854,387 | A | | 12/1974 | Steckle | |
| 3,881,765 | A | | 5/1975 | Cerra et al. | |
| 3,911,831 | A | | 10/1975 | Blunden | |
| 3,927,621 | A | | 12/1975 | Skeltis et al. | |
| 3,938,446 | A | | 2/1976 | Seitz et al. | |
| 3,977,123 | A | | 8/1976 | Clay, Jr. et al. | |
| 3,995,563 | A | | 12/1976 | Blunden | |
| 3,996,860 | A | | 12/1976 | Ravani et al. | |
| 4,019,442 | A | | 4/1977 | Lee et al. | |
| 4,059,055 | A | | 11/1977 | Ravani et al. | |
| 4,077,330 | A | | 3/1978 | Peisner et al. | |
| 4,119,042 | A | | 10/1978 | Naves et al. | |
| 4,119,043 | A | | 10/1978 | Naves et al. | |
| 4,119,750 | A | | 10/1978 | Porter | |
| 4,149,472 | A | | 4/1979 | Naves et al. | |
| 4,164,189 | A | | 8/1979 | Fritz et al. | |
| 4,236,605 | A | | 12/1980 | Lindbergh | |
| 4,238,168 | A | | 12/1980 | Naves | |
| 4,240,357 | A | | 12/1980 | Phillips | |
| 4,248,557 | A | | 2/1981 | Roldness et al. | |
| 4,271,649 | A | | 6/1981 | Belanger | |
| 4,286,817 | A | | 9/1981 | Moritz | |
| 4,287,833 | A | | 9/1981 | Roldness et al. | |
| 4,324,189 | A | | 4/1982 | Roldness | |
| 4,428,993 | A | | 1/1984 | Kohn et al. | |
| 4,759,669 | A | | 7/1988 | Robertson et al. | |
| 4,787,669 | A | | 11/1988 | Wante | |
| 4,801,229 | A | | 1/1989 | Hanada et al. | |
| 4,801,483 | A | | 1/1989 | Beckerman et al. | |
| 4,936,227 | A | | 6/1990 | Baker et al. | |
| 5,100,730 | A | | 3/1992 | Lambers | |
| 5,181,474 | A | | 1/1993 | Miller | |
| 5,218,794 | A | | 6/1993 | Ehrlich | |
| 5,233,799 | A | | 8/1993 | Abukawa | |
| 5,279,230 | A | | 1/1994 | Thomas et al. | |
| 5,302,063 | A | | 4/1994 | Winsor | |
| 5,312,213 | A | | 5/1994 | Winsor | |
| 5,320,046 | A | | 6/1994 | Hesch | |
| 5,392,717 | A | | 2/1995 | Hesch et al. | |
| 5,423,269 | A | | 6/1995 | Saxton et al. | |
| 5,454,672 | A | | 10/1995 | Halpin et al. | |
| 5,462,623 | A | | 10/1995 | Day | |
| 5,511,491 | A | | 4/1996 | Hesch et al. | |
| 5,566,508 | A | | 10/1996 | Houston | |
| 5,589,243 | A | | 12/1996 | Day | |
| 5,601,033 | A | | 2/1997 | Ehrlich et al. | |
| 5,622,115 | A | | 4/1997 | Ehrlich et al. | |
| 5,676,507 | A | | 10/1997 | Lugo | |
| 5,685,228 | A | | 11/1997 | Ehrlich et al. | |
| 5,730,485 | A | | 3/1998 | Sjostedt et al. | |
| 5,743,192 | A | * | 4/1998 | Saxton et al. | 105/355 |
| 5,794,537 | A | | 8/1998 | Zaerr et al. | |
| 5,834,082 | A | | 11/1998 | Day | |
| 5,890,435 | A | | 4/1999 | Thoman et al. | |
| 5,928,735 | A | | 7/1999 | Padmanabhan et al. | |
| 5,979,335 | A | | 11/1999 | Saxton et al. | |
| 6,138,579 | A | | 10/2000 | Khattab | |
| 6,138,580 | A | | 10/2000 | Thoman | |
| 6,179,942 | B1 | | 1/2001 | Padmanabhan | |
| 6,183,824 | B1 | | 2/2001 | Padmanabhan et al. | |
| 6,283,040 | B1 | | 9/2001 | Lewin | |
| 6,325,579 | B1 | | 12/2001 | Jarvis | |
| 6,368,035 | B1 | | 4/2002 | Recupido et al. | |
| 6,393,999 | B1 | | 5/2002 | Schneider | |
| 6,446,561 | B1 | | 9/2002 | Khattab | |
| 6,540,275 | B1 | | 4/2003 | Iwamoto et al. | |
| 6,550,400 | B1 | | 4/2003 | Forbes | |
| 6,623,223 | B1 | | 9/2003 | Wrobley et al. | |
| 6,647,898 | B2 | | 11/2003 | Li | |
| 6,659,016 | B2 | * | 12/2003 | Forbes | 105/355 |
| 6,736,071 | B2 | | 5/2004 | Engle | |
| 6,749,380 | B2 | | 6/2004 | Recupido et al. | |
| 7,055,441 | B2 | | 6/2006 | Jarvis | |
| 7,182,569 | B2 | | 2/2007 | Wrobley et al. | |
| 7,360,979 | B2 | | 4/2008 | Forbes | |
| 7,401,559 | B2 | | 7/2008 | Dawson et al. | |
| 7,802,525 | B2 | | 9/2010 | Dawson et al. | |
| 8,371,236 | B2 | | 2/2013 | Budnick | |
| 2004/0000253 | A1 | * | 1/2004 | Schorr et al. | 105/355 |
| 2004/0016362 | A1 | * | 1/2004 | Cencer et al. | 105/355 |
| 2006/0219129 | A1 | | 10/2006 | Jarvis | |
| 2007/0227395 | A1 | | 10/2007 | Zaerr | |
| 2008/0141897 | A1 | | 6/2008 | Zaerr | |
| 2010/0180516 | A1 | | 7/2010 | Dawson et al. | |
| 2013/0263757 | A1 | * | 10/2013 | Rezaei et al. | 105/355 |

OTHER PUBLICATIONS

Wabash National, Split Deck AutoRailer Trailer, undated.
Wabash National, AutoRailer Van, advertising material, dated 1995.
Wabash National, The Allrailer Multilevel Railcar, advertising material regarding car in use by Sep. 1995.

* cited by examiner

RAILROAD CAR FOR CARRYING MOTOR VEHICLES

BACKGROUND OF THE INVENTION

The present invention relates to railroad freight cars useful for carrying motor vehicles, and particularly to cars capable of carrying motor vehicles on either two or three levels.

Railroad freight cars have long been used for transporting newly manufactured motor vehicles long distances from the point of manufacture or a port of arrival to cities where dealerships are located or to railroad terminals where the motor vehicles are reloaded onto trucks for transport over highways to the locations of dealerships. In order for such railroad freight cars to be most economical it is desirable to carry a maximum number of motor vehicles on each railroad car, but it is also desired to be able to carry several different types of motor vehicles on each car and to be able to reconfigure the railroad freight car to carry such different types of vehicles without undue difficulty.

It is known to adjust load-carrying decks in motor vehicle-carrying railroad cars to facilitate carrying different types of motor vehicles, but cars capable of such adjustments in the past have not been completely satisfactory.

Railroad cars are restricted in size to fit within clearance envelopes established by agreements reached among railroads, in order to avoid collisions between trains on adjacent tracks and to ensure that all cars fit within the clearances available along the rail lines at places such as bridges and tunnels.

In order to avoid pilferage or vandalism of motor vehicles and to protect motor vehicles from airborne hazards, many railroad freight cars designed to carry motor vehicles are enclosed and include roofs and end doors. The overall height of such a car, including its roof, is limited by the applicable clearance envelope, in order for the car to be able to be used without special routing considerations. At the same time, however, there must be sufficient interior vertical clearance height for safe carriage of the desired types of motor vehicles, with the railroad freight car in either its bi-level or its tri-level configuration. Also, motor vehicle-carrying railroad cars must meet certain deck height requirements to allow for movement of motor vehicles from car to car in a "circus loading" fashion.

What is needed, then, is an improved railroad freight car which is easily adjustable to serve to carry a maximum number of motor vehicles of different sizes and to provide ample protection of such motor vehicles against pilferage and against damage from the elements, and which is convertible between a tri-level configuration and a bi-level configuration. Such a car should also conform to the clearance envelope applicable to operation on all ordinary rail lines.

SUMMARY OF THE INVENTION

The present invention overcomes some of the aforementioned shortcomings of prior art railroad cars by providing an improved railroad freight car for carrying motor vehicles on multiple levels, in a railroad car body including a pair of vehicle-carrying decks that can be located separately at different respective heights to provide a tri-level configuration or located closely above one another to provide a bi-level configuration in a car that fits within a standard clearance envelope, with prescribed vertical clearance heights above the vehicle-carrying decks.

A railroad car which is one embodiment of the invention includes protective side walls of sheet metal construction each including side posts extending upwardly to a top chord of the car body.

In one embodiment of the present invention a pair of movable motor vehicle-carrying decks are spaced upwardly above the lowest vehicle-carrying deck, where they are supported by the side posts and adjustable in height, between separate spaced-apart positions in a tri-level configuration and closely adjacent positions in a bi-level configuration of the car.

In one embodiment of the present invention the moveable upper and intermediate vehicle-carrying decks are cambered, with the upper vehicle-carrying deck having a greater camber, with a lesser radius of curvature, than the intermediate vehicle-carrying deck. When the two decks are nested closely adjacent to each other in a bi-level configuration of the car, such cambers of the movable decks cooperatively provide a minimal combined vertical dimension of the two decks at the locations where vertical clearance is critical, so as to maximize between-decks vertical clearance heights for motor vehicles when the car is in a bi-level configuration.

In a railroad car which is one embodiment of the present invention a raised structure or ramp is provided along each side of the draft gear housing, on each lateral side of the car, near the opposite ends of the car, with the raised structure having a vehicle-supporting top surface located at a prescribed height above the top of the rail height, so as to be aligned properly with a bridge extending between the car and an adjacent car or a loading dock.

In one embodiment of the railcar disclosed herein an end portion of a movable intermediate vehicle-carrying deck is hinged, allowing its outer end to be raised to provide clearance in a tri-level configuration of the railcar. The hinges can be disconnected and the end portion can be moved longitudinally atop a mid-length portion of the intermediate deck, to provide ample vertical clearance height between the bottom deck and the upper vehicle-carrying deck at an end of the railcar in its bi-level configuration.

The foregoing and other objectives, features, and advantages of the invention will be more readily understood upon consideration of the following detailed description of the invention, taken in conjunction with the accompanying drawings.

DETAILED DESCRIPTION OF EMBODIMENTS

Figure 1:
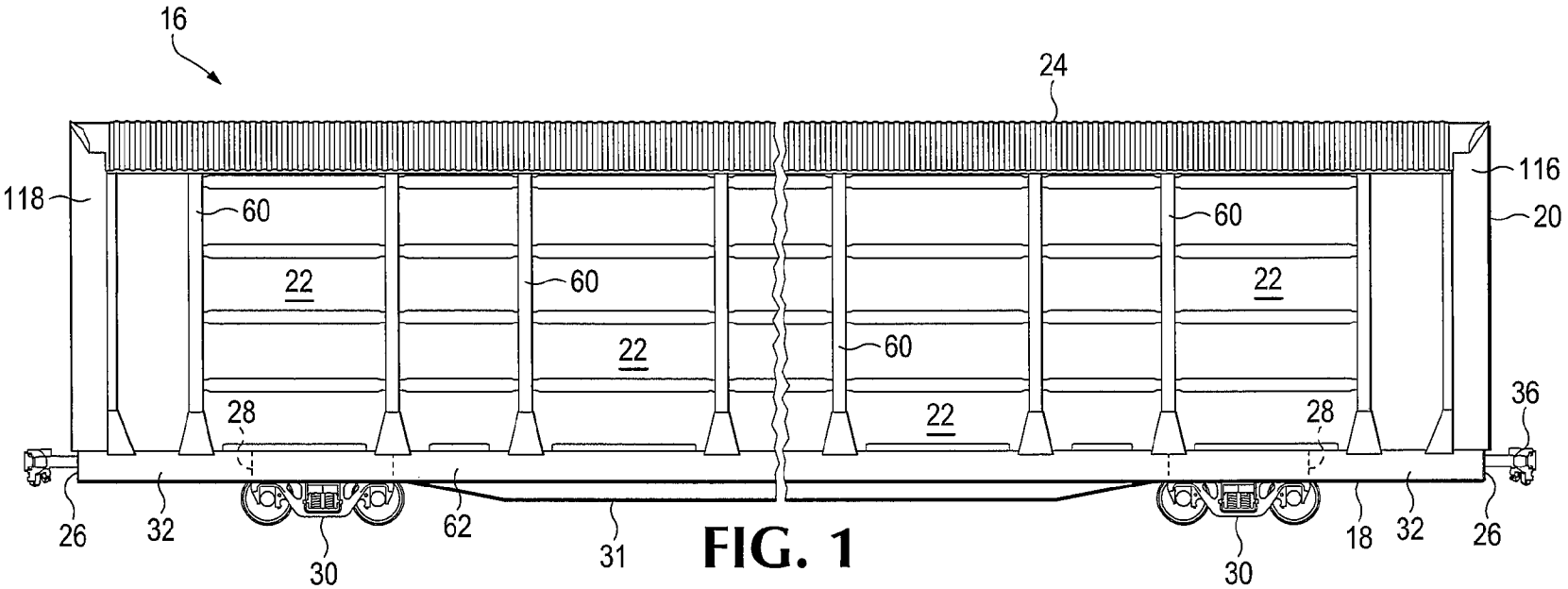
FIG. 1 is a foreshortened side elevational view of a motor vehicle-carrying railroad car embodying an aspect of the present invention.

Referring now to FIGS. 1-10 of the drawings which form a part of the disclosure herein, a motor vehicle-carrying, or auto rack railcar 16 which embodies the present invention includes an underbody 18 supporting an auto rack portion 20, or superstructure, that includes side walls 22 extending upward above the underbody and a roof 24 extending above and between the side walls 22.

In the motor vehicle-carrying railcar 16 the underbody 18 may be essentially a conventional low level flat car including a pair of body bolsters 28 located at opposite ends 26 of the car 16 and supported on respective wheeled trucks 30. A drop center sill 31 extends between the body bolsters 28 and a respective end portion 32 of the underbody 18 is longitudinally outboard of the body bolster 28 at each end. At a prescribed height 35 above the top of the rail (TOR) 34 on which the railcar 16 is located there is a coupler 36 at each end of the underbody 18, and a draft gear housing 38 is included in the underbody 18, located centrally of the width of the end portion 32, to receive and house the draft gear associated with the coupler 36. The draft gear housing 38 includes a top surface 40 at a height 42 which may be about 3 feet 5⅛ inches above the top of rail 34. The draft gear housing 38 extends over a length 44 of about 7 feet.

The underbody 18 includes a bottom vehicle-carrying deck 46 of which respective portions 48 extend alongside each lateral side 49 of the draft gear housing 38 from an end sill 50 toward the respective body bolster 28 in the respective end portion 32. A conventional bridge mounting connection 52 is provided in the end portion of the bottom vehicle-carrying deck 46 in each lateral side portion, alongside the draft gear housing 38, to receive a bridge (not shown) that may extend between the end sill 50 of the car 16 and an end sill of an adjacent auto rack car or a loading dock.

In the auto rack portion 20 and spaced upwardly above the bottom vehicle-carrying deck 46 is an intermediate vehicle-carrying deck 58 supported on side posts 60 included in the side walls 22 and extending upward above side sills 62 extending longitudinally from end to end of the underbody 18. The side posts 60 also support a top chord member 63 and the roof 24 that extends angularly upward and inward and across the top of the auto rack, interconnecting the side walls 22 of the auto rack and providing protection against the elements.

Figure 2:
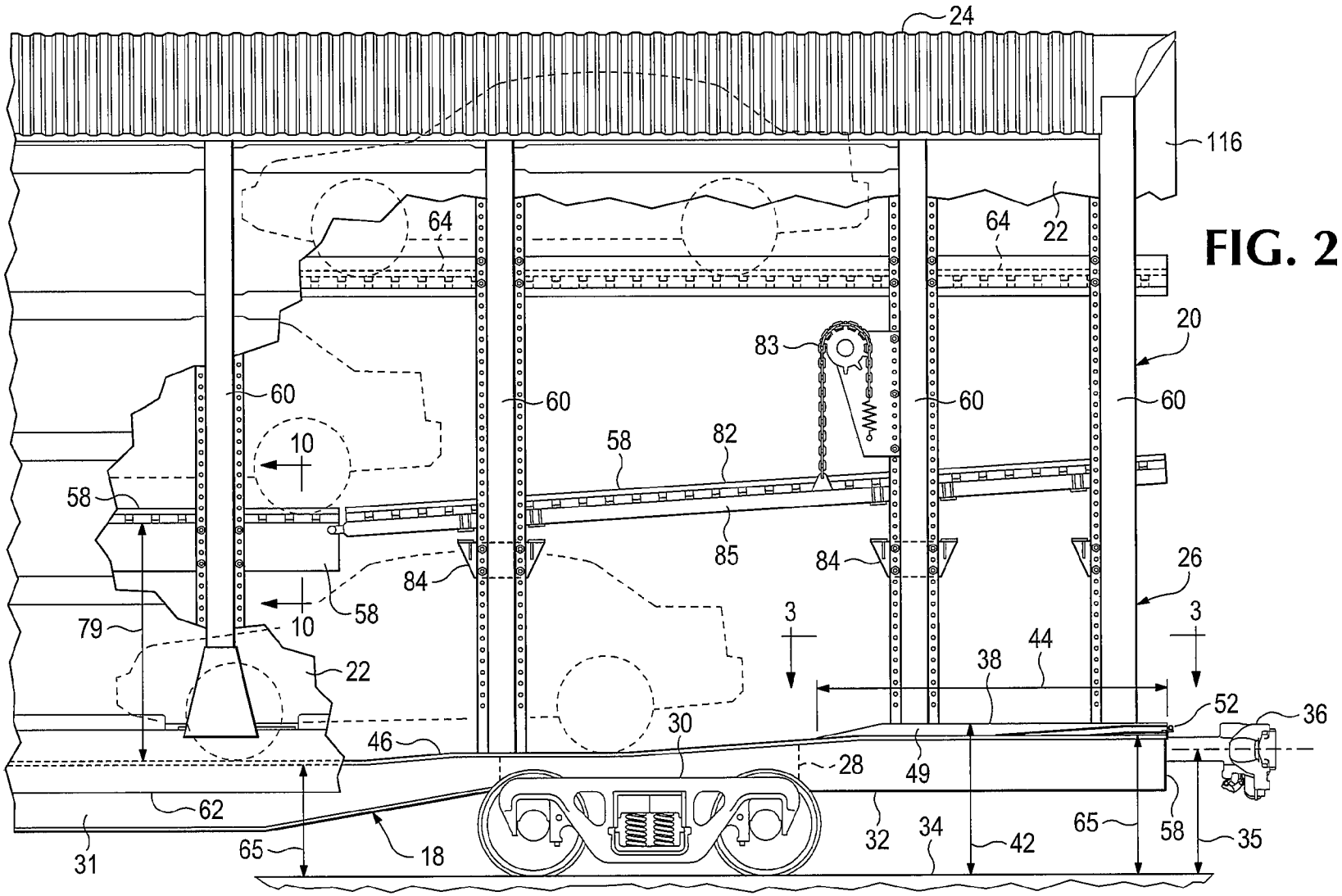
FIG. 2 is a partially cutaway side elevational view of a portion of the railroad car shown in FIG. 1, at an enlarged scale.
Figure 6:
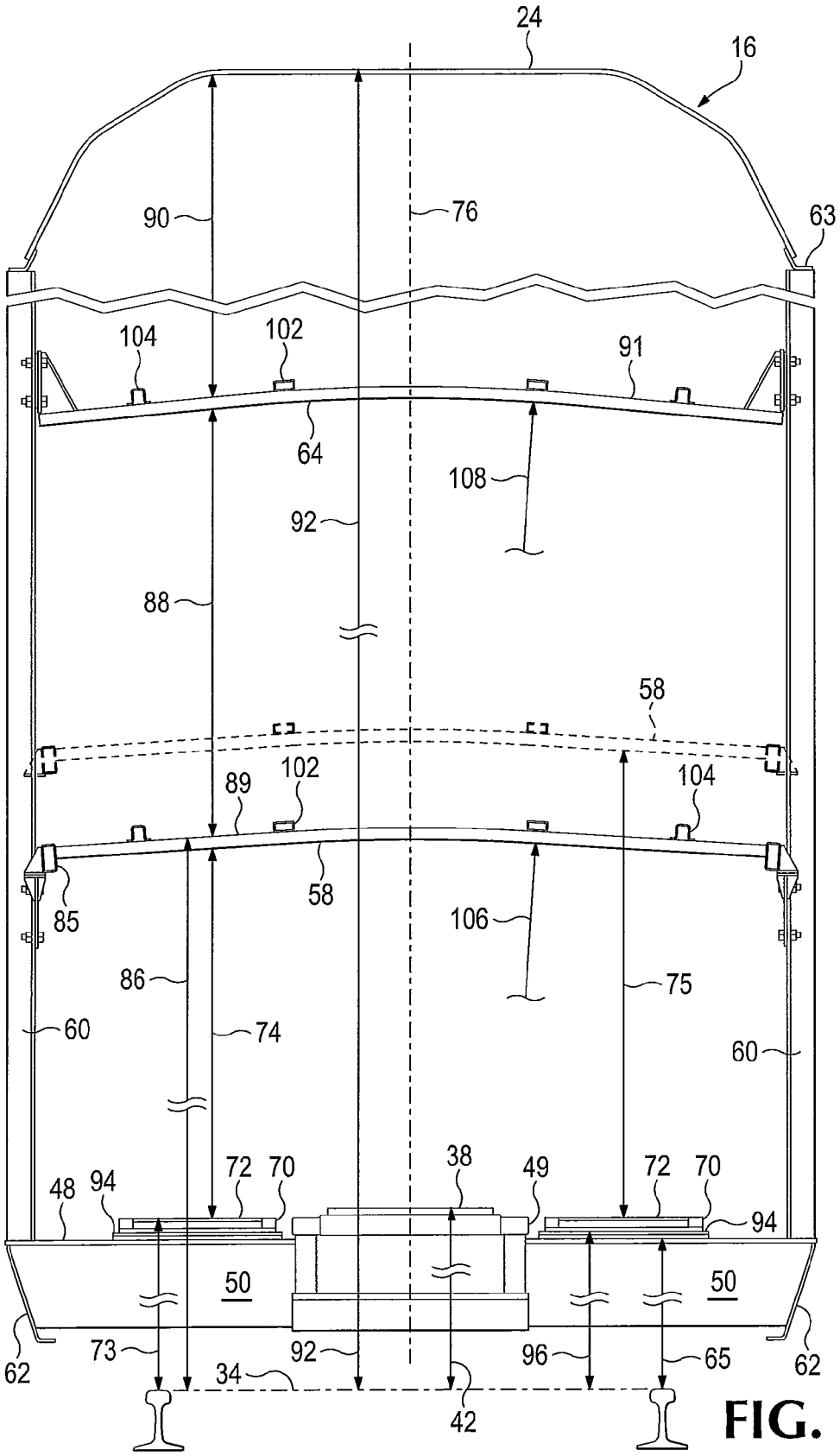
FIG. 6 is an end elevational view of the body of the railroad car shown in FIGS. 1 and 2, at an enlarged scale, but foreshortened in height, showing the car in a tri-level configuration.

An upper vehicle-carrying deck 64 is also supported by the side posts 60 and is also moveable between several different heights. As shown in FIGS. 2 and 6 the intermediate vehicle-carrying deck 58 and the upper vehicle-carrying deck 64 are mounted in a tri-level configuration of the auto carrying railcar 16, in which motor vehicles may be supported on each of the bottom deck 46, intermediate deck 58, and upper deck 64, with sufficient vertical clearance for the height of a passenger vehicle of a selected class on each of the vehicle-carrying decks, as will be explained in greater detail presently.

A standard height of 3 feet 7½ inches above TOR has been established for the end of a railcar in a tri-level configuration for carrying automobiles, to assure that such railcars can be coupled to one another to allow for circus loading of automobiles moving across a bridge extending between adjacent railcar ends. The height of the end portion 32 of a railcar is prescribed to be within 3 inches of the standard height. In the railcar 16, the height 65 of the bottom vehicle-carrying deck 46 in the end portion of the car, adjacent to the end sill 50, is 3 feet 1⅞ inch. Accordingly a vehicle wheel-supporting ramp 70 is provided in the end portion 32 of the underbody 18, extending from the end sill 50 longitudinally into the car a distance 71 of, for example, about 4 feet. An upper wheel-supporting surface 72 of the ramp 70 has a height of 2⅝ inches above the top surface of the portions 48 of the bottom vehicle-carrying deck 46 at the end of the car body, so that the ramp 70 has a ramp top height 73 of 3 feet 4½ inches above TOR 34, and thus is located within the 3 inch range permitted as a variation from the standard 3 feet 7½ inch height. A pair of such ramps 70 are located in the end portion 32 of the car 16, with one of the ramps 70 on the deck portion 48 at each lateral side of the draft gear housing 38. This provides a minimum vertical clearance height 74 of 54 inches above the upper wheel-supporting surface 72 of the ramp 70 and beneath the lowest surface of the intermediate vehicle-carrying deck 58, as may be seen in FIG. 6. Unless otherwise described, the vertical clearance height above a vehicle-carrying deck, or the height of a deck, as mentioned herein is measured at a lateral distance of 30 inches from a vertical longitudinal center plane 76 of the railcar 16, as required by the American Association of Railroads (AAR) standards related to Plate J clearances.

Figure 3:
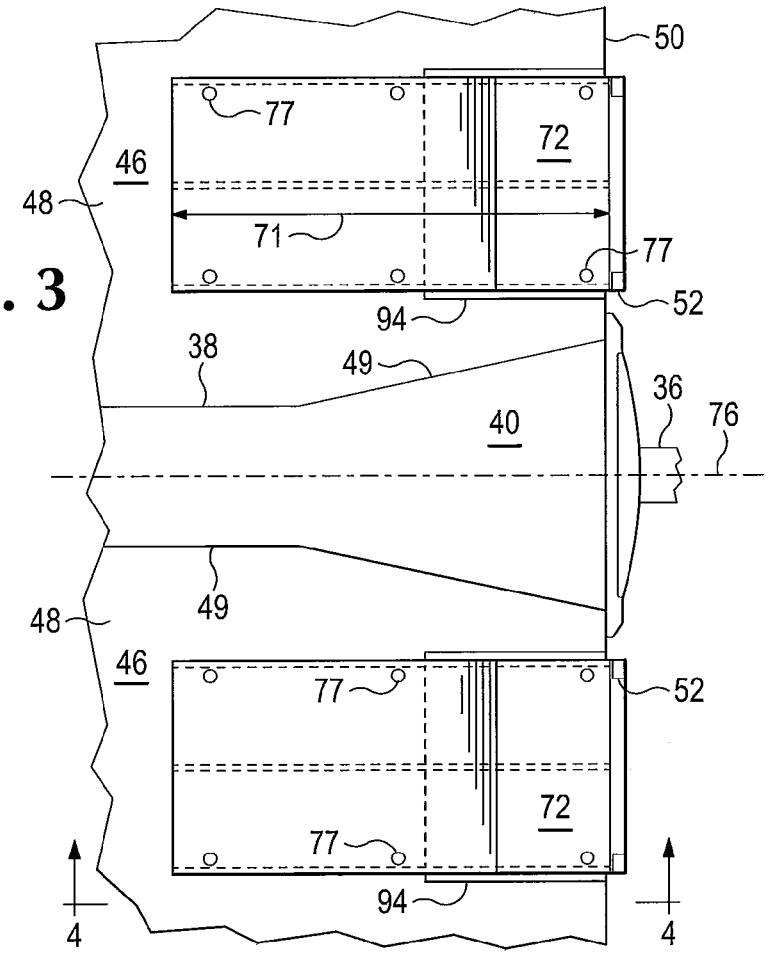
FIG. 3 is a fragmentary view of a portion of the railroad car shown in FIG. 2, taken in the direction indicated by the line 3-3 in FIG. 2.
Figure 4:
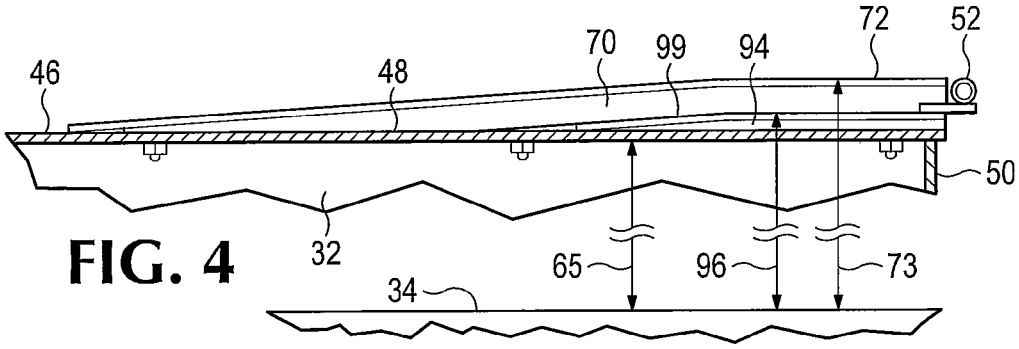
FIG. 4 is a sectional view taken along line 4-4 in FIG. 3.
Figure 5:
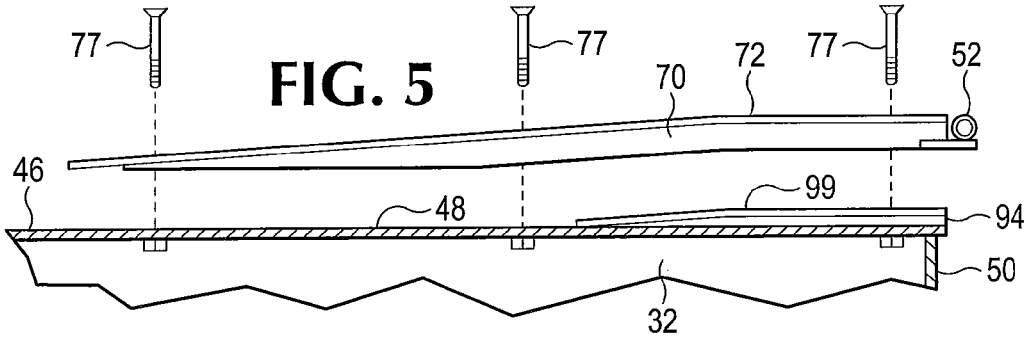
FIG. 5 is an exploded view similar to that of FIG. 4, showing a removable ramp spaced apart from the position in which it is shown in FIG. 4.
Figure 7:
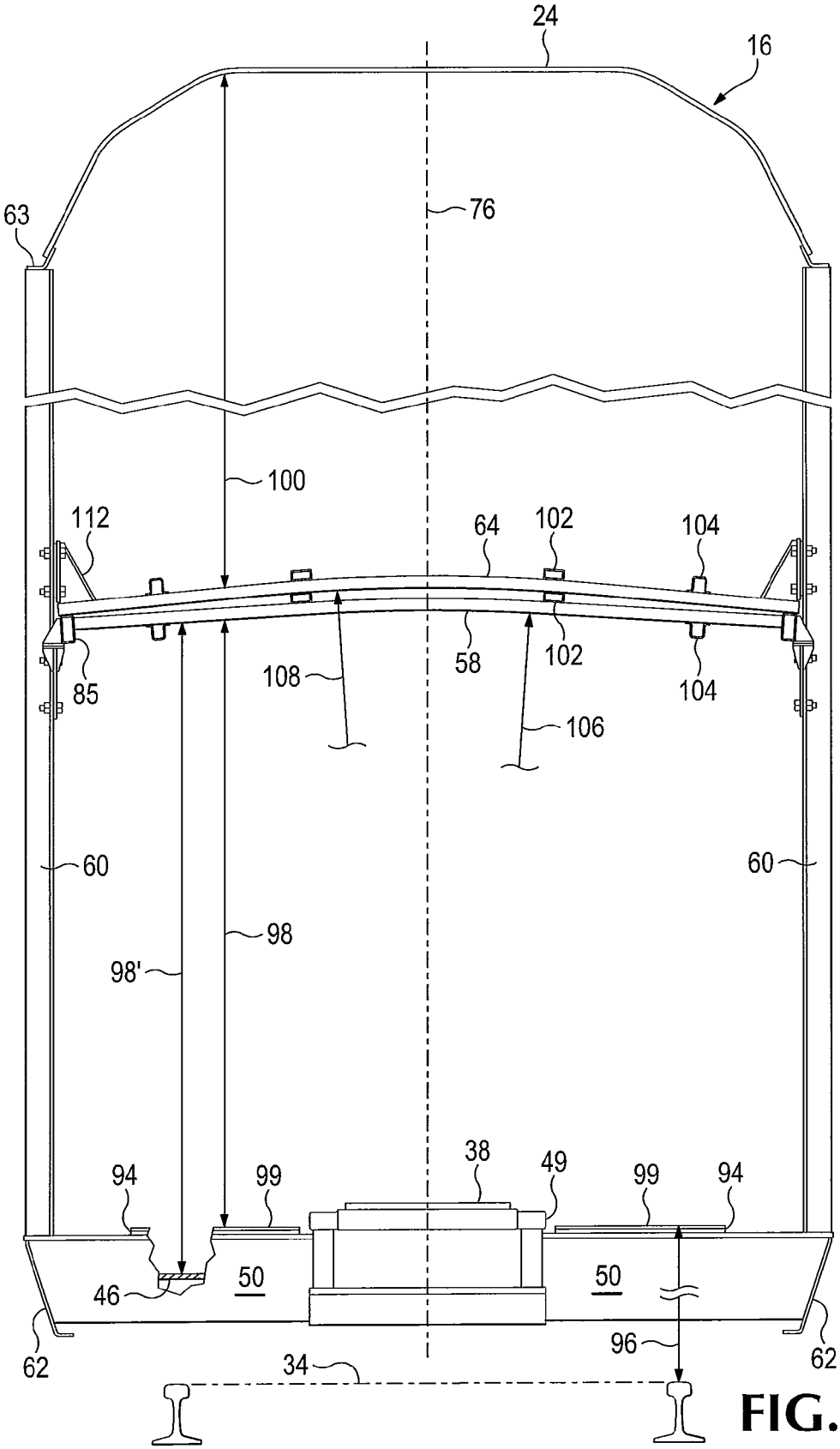
FIG. 7 is a partially cutaway view similar to FIG. 6, but showing the car in a bi-level configuration in which a pair of vehicle-carrying decks have been placed closely adjacent to each other.
Figure 8:
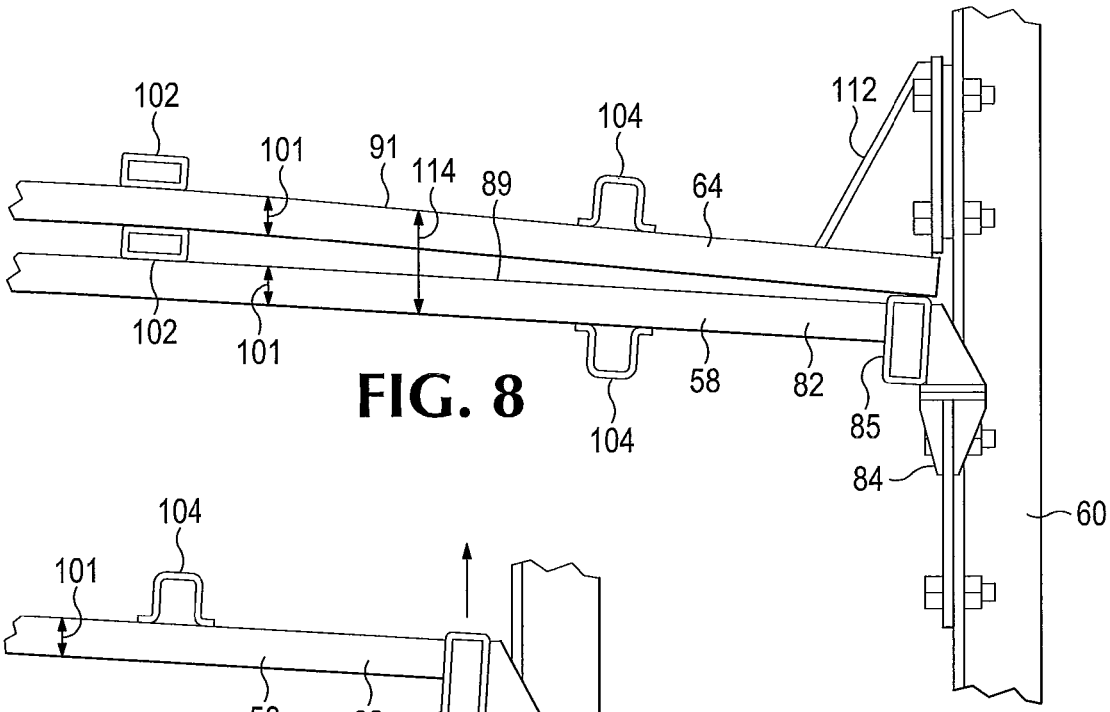
FIG. 8 is a fragmentary view showing a detail of the car body shown in FIG. 7 at an enlarged scale.

As shown in FIGS. 3, 4, and 5, the ramp 70 may be fastened to the bottom vehicle-carrying deck 46 by conventional removable means, such as by threaded fasteners 77, quick release fasteners (not shown), etc., so that the ramps 70 may be removed without undue difficulty in converting the automobile carrying railcar 16 from the tri-level configuration shown in FIGS. 2 and 6 to a bi-level configuration, as shown in FIGS. 7 and 8. The ramps 70 may be attached to part of the railcar out of the way of motor vehicles to be carried, so as to be readily available for reconfiguration to the tri-level configuration when desired. As shown in FIG. 2, at a location within the automobile carrying railcar 16 in the tri-level configuration, in a middle portion of the length of the car 16, there is a vertical clearance height 79 of 63 1/16 inches above the bottom vehicle-carrying deck 46 to the lowest surface of the intermediate vehicle-carrying deck 58, which is thus greater than the standard required clearance of 62⅜ inches.

Figure 9:
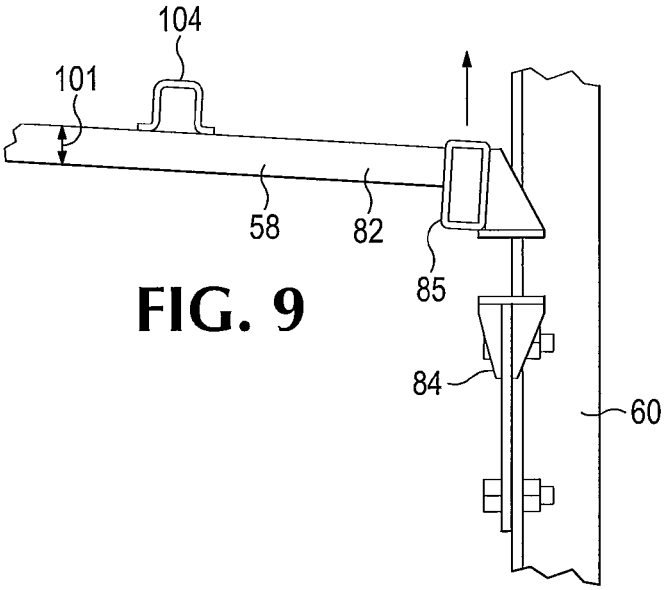
FIG. 9 is a fragmentary view showing a detail of the car body shown in FIG. 6 with a moveable end portion of an intermediate vehicle-carrying deck shown in a partially raised position.
Figure 10:
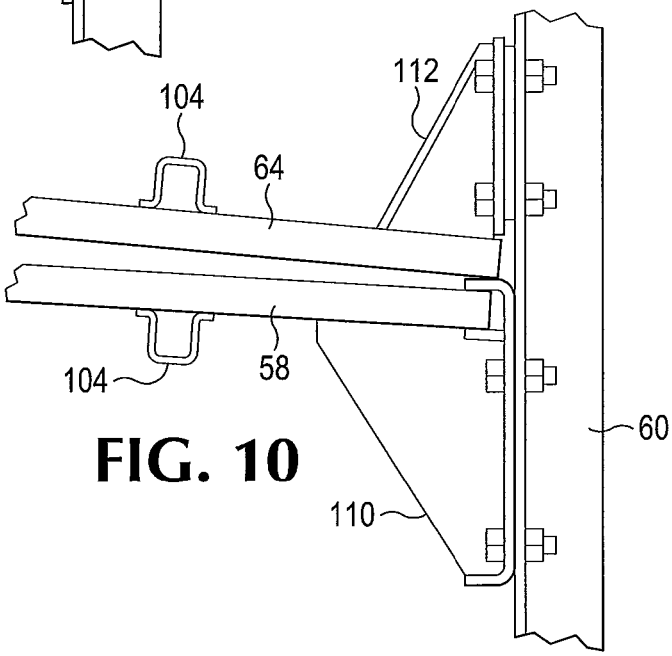
FIG. 10 is a detail view taken along line 10-10 in FIG. 2, showing the manner in which a lateral side of the intermediate vehicle-carrying deck is attached to one of the side posts in a mid-length part of the railcar.

When the railcar 16 is in the tri-level configuration as shown in FIGS. 2 and 6, a hinged end portion 82 of the intermediate vehicle-carrying deck 58 may be raised to an inclined position as shown in side elevational view in FIG. 2, to provide an ample vertical clearance height above the ramps 70 in the end portions 32 of the car during loading of motor vehicles onto the bottom vehicle-carrying deck 46. This provides a vertical clearance height 75 of 63 1/16 inches above the upper wheel supporting surface 72 of the ramp 70. Various arrangements are known for supporting the movable end portions 82 of such a vehicle-carrying deck 58 in the raised position, including a spring and chain arrangement 83. Once the desired motor vehicles have been placed onto the bottom vehicle-carrying deck 46 the end portions 82 of the intermediate vehicle-carrying deck 58 may be lowered to a horizontal orientation, aligned with the longitudinally central part of the intermediate vehicle-carrying deck 58, as shown in solid line in FIG. 6. Lateral margins of the movable end portion 82 may include longitudinal structural members 85, and may be supported on brackets 84 mounted on respective ones of the side posts 60 at a suitable height, as shown in FIG. 9. Upper surfaces of the intermediate vehicle-carrying deck 58 then have a height 86 of 8 feet, 11/16 inch above the height of the TOR 34, which is equal to the standard height prescribed for such a tri-level automobile carrying railcar. Conventional bridge members (not shown) can then be connected to the ends of the intermediate vehicle-carrying deck 58 to move motor vehicles onto or off from the railcar 16 onto an adjacent car or loading dock.

A vertical clearance height 88 of 61 7/8 inches is provided between the top vehicle wheel supporting surfaces 89 of the intermediate vehicle-carrying deck 58 and the lowest bottom surfaces of the upper vehicle-carrying deck 64 with the upper vehicle-carrying deck 64 in the required position along the side posts 60 in the tri-level configuration. This places the top wheel-supporting surface 91 of the upper vehicle-carrying deck 64 at a height of 13 feet, 4 3/4 inches above TOR 34, within the allowable range relative to the standard height of 13 feet, 4 3/8 inches for the upper deck in a tri-level configuration.

This also leaves a vertical clearance height 90 of 65 5/8 inch above the top vehicle wheel supporting surfaces 91 of the upper vehicle-carrying deck 64 and beneath the bottom surfaces of the roof 24, a clearance which is greater than the minimum required standard clearance of 64 7/8 inches beneath the bottom surfaces of a roof for an auto rack car in a tri-level configuration.

While auto rack cars have previously been available with the required between-decks vertical clearances for a tri-level configuration, such cars not exceeding the maximum overall height 92 of 19 feet 0 inches above TOR 34 as required by AAR Plate J have not been convertible to a bi-level configuration except by removing either the intermediate vehicle-carrying deck 58 or the upper vehicle-carrying deck 64 from the railcar to attain the bi-level configuration and still provide the required vertical clearances.

In the present motor vehicle-carrying railcar 16, however, the intermediate vehicle-carrying deck 58 is raised, and the upper vehicle-carrying deck 64 is lowered, to bring those two moveable decks together into respective positions along the side posts 60 in which the upper vehicle-carrying deck 64 is closely adjacent and above the intermediate vehicle-carrying deck 58, as shown in FIGS. 7 and 8.

With the automobile carrying railcar 16 in that bi-level configuration as shown in FIGS. 7 and 8, ramps 94, similar to but lower in height than the ramps 70, may be provided in positions similar to the positions of the ramps 70 as shown. In the railcar 16 as shown the ramps 70 are located partially atop the ramps 94, as shown in FIGS. 2-6. The ramps 94, as shown best in FIGS. 3, 4, and 5, may be 7/8 inch in height above the portions 48 of the bottom vehicle-carrying deck 46 at the end sill 50, so that the top vehicle-carrying surfaces 99 of the ramps 94 are at a height 96 of 3 feet 2 3/4 inches above TOR at the end sill 50, with the car 16 in the bi-level configuration. This height is thus within 3/4 inch of an older, but still applicable standard height above TOR for the bottom deck of a bi-level automobile-carrying railcar, and less than 3 inches lower than the more recently established standard height of the bottom deck at the ends of a bi-level automobile-carrying railcar. This also provides a vertical clearance height 98 of 87 inches (7 feet 3 inches) between the top vehicle-carrying surfaces 99 of the ramps 94 and the lowest bottom surface of the hinged portion 82 of the intermediate vehicle-carrying deck 58.

The vertical clearance height 98 of 87 inches, in the end portions 32 of the car 16, above the ramps 94 and beneath the hinged portion 82 of the intermediate vehicle-carrying deck 58 thus satisfies the AAR Plate J standard requirement for a minimum of 87 inches clearance between the lower deck and the upper deck of a bi-level auto rack configuration. In a longitudinally central portion of the car, between the body bolsters 28, in the bi-level configuration there is a significantly greater vertical clearance height 98' of 7 feet 8 5/8 inches between the top surface of the bottom vehicle-carrying deck 46 and the lowest bottom surface of the horizontal portion of the fixed intermediate vehicle-carrying deck 58, as shown in FIG. 7.

The AAR standard minimum clearance above the upper vehicle-carrying deck 64 in a bi-level configuration is 93 1/4 inches, and in the automobile carrying railcar 16 the vertical clearance height 100 in the bi-level configuration is 93 3/8 inches beneath the lower, inner, surface of the roof 24, thus satisfying the minimum clearance requirement.

The clearances described in the preceding paragraphs are enabled by the structural dimensions and the cooperative configuration of the intermediate and upper vehicle-carrying decks 58 and 64, which permits them both to be kept in the interior of the car in converting the car 16 from the tri-level configuration to the bi-level configuration. Each of the movable vehicle-carrying decks 58 and 64 is constructed primarily of corrugated sheet metal with corrugations extending transversely and with each deck including an upwardly arched camber. The corrugated portions of the movable vehicle-carrying decks 58 and 64 may have respective top to bottom thicknesses 101 of about 1.75 inches. Each of the decks 58 and 64 includes a pair of parallel longitudinally-extending reinforcing members 102 which may be of rectangular tubular configuration and which may be spaced apart laterally from one another by a distance of about 4 feet, centered along the longitudinal vertical center plane 76 of the car 16.

A curb member 104, spaced laterally outward from each of the reinforcing members 102, is located on the upper face of each of the intermediate and upper vehicle-carrying decks 58 and 64 when the car is in the tri-level configuration, at a distance of about 18 inches from the lateral sides of the decks. The curbs 104 serve to prevent a motor vehicle from wandering too close to one of the side walls 22 or posts 60, and also add desired rigidity and stability to the deck structures. The curb members 104 may be attached to the end portions 82 of the intermediate vehicle-carrying deck 58 by bolts, for example, and can be removed and stored on the underside of the intermediate vehicle-carrying deck 58 when the car 16 is in the bi-level configuration.

As one way to bring the intermediate vehicle-carrying deck 58 close enough to the upper vehicle-carrying deck 64 to provide the necessary vertical clearances between decks and above the upper vehicle-carrying deck 64 in the bi-level configuration, the cambers of the two decks are slightly different, as shown in FIGS. 6 and 7. That is, the radius of curvature 106 of the camber of the intermediate vehicle-carrying deck 58 is greater than the radius of curvature 108 of the upper vehicle-carrying deck 64. For example, the radius 106 may be 275 inches, while the radius 108 may be 264 inches, in one embodiment.

In placing the car 16 into the bi-level configuration, then, the curbs 104 are removed from the top of the intermediate vehicle-carrying deck 58 and the two decks are moved toward each other and attached to the side posts 60 in respective positions where the lateral margins of the two decks are at least nearly in contact with each other. A mounting and support bracket 110 on the bottom side of the intermediate vehicle-carrying deck 58 supports the intermediate vehicle-carrying deck and attaches it to the side posts 60 in the mid-length portion of the car 16, while an upwardly extending mounting and support bracket 112 attaches the upper vehicle-carrying deck 64 to the side posts 60. Because of the different camber curvatures of the intermediate and upper vehicle-carrying decks 58 and 64, there is room for the longitudinally extending reinforcing members 102 on the top of the intermediate vehicle-carrying deck 58, between the top of the intermediate vehicle-carrying deck 58 and the bottom of the upper vehicle-carrying deck 64, as shown in FIGS. 7 and 8. This combination of the two cambered vehicle-carrying decks with different radii of curvature results in a combined height 114 of the paired intermediate and upper vehicle-carrying decks in the bi-level configuration that is less than would be the case if both cambered decks had the same radius of curvature. The smaller combined height 114 of the two decks results in additional vertical spacing above and below the paired decks at the locations relative to the width of the railcar 16 where vertical clearance heights are specified.

At each end of the car a pair of tri-fold doors 116, 118 may be provided to protectively enclose automobiles within the car. Such doors can be folded and moved laterally apart from each other to positions at the corners of the car body, leaving ample room between the doors 116, 118 for vehicles to be loaded onto or removed from the car 16.

Figure 11:
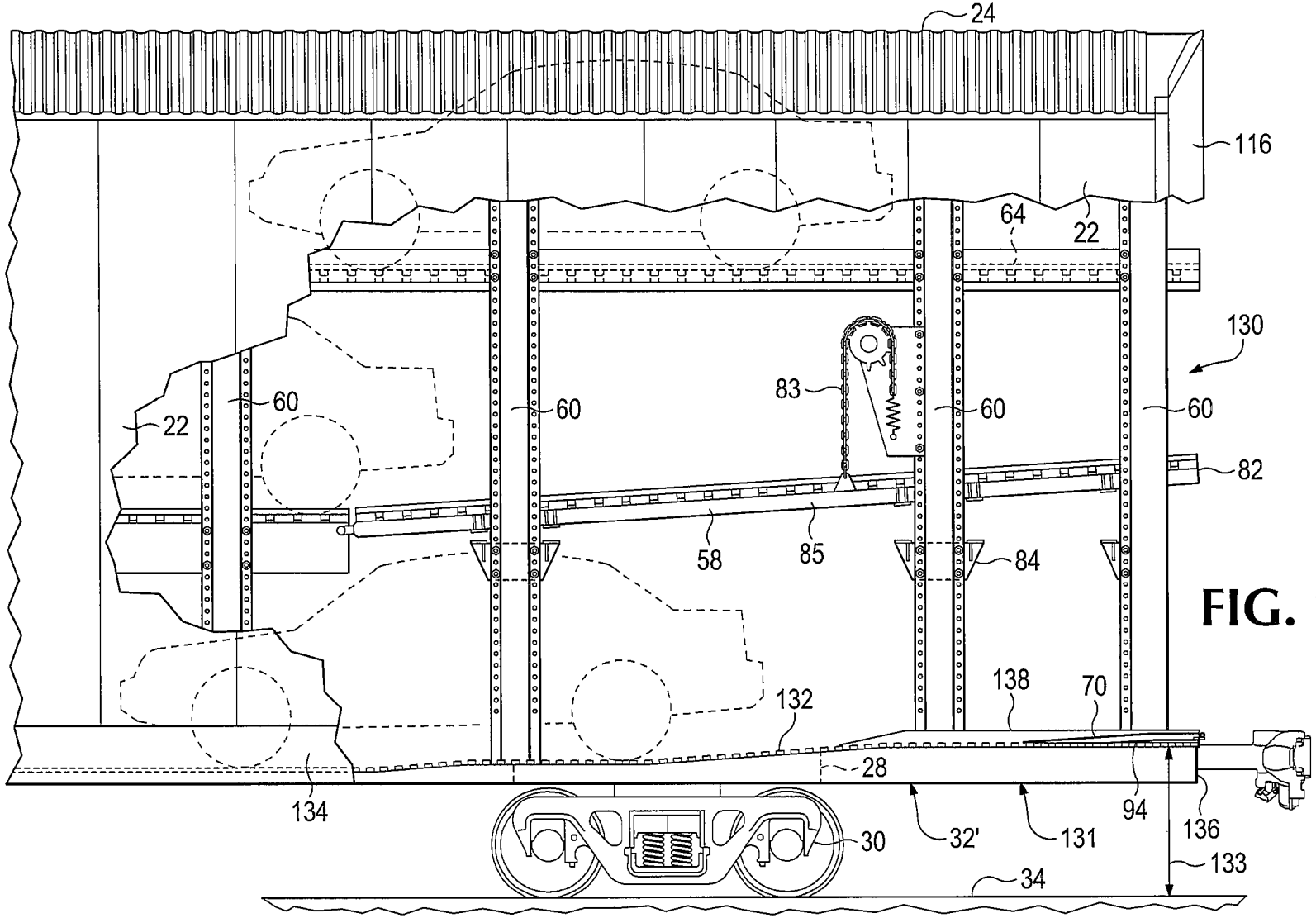
FIG. 11 is a partially cutaway side elevational view of a portion of a railroad car that is a different embodiment of the present invention.
Figure 12:
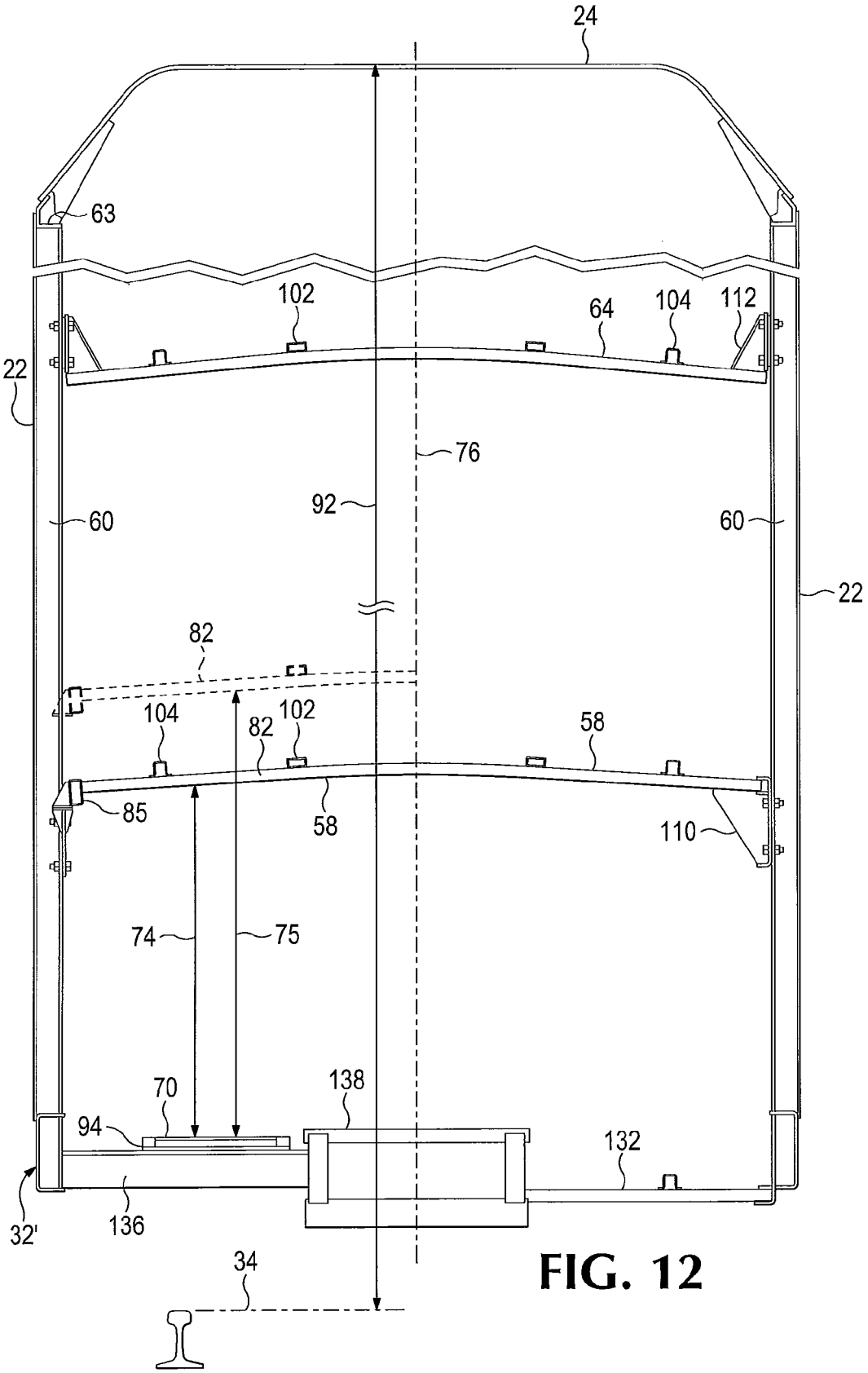
FIG. 12 is an end elevational view, partially foreshortened in height, of the railroad car shown in FIG. 11, showing the configuration at two different points along the length of the car, with the car in a tri-level configuration.
Figure 13:
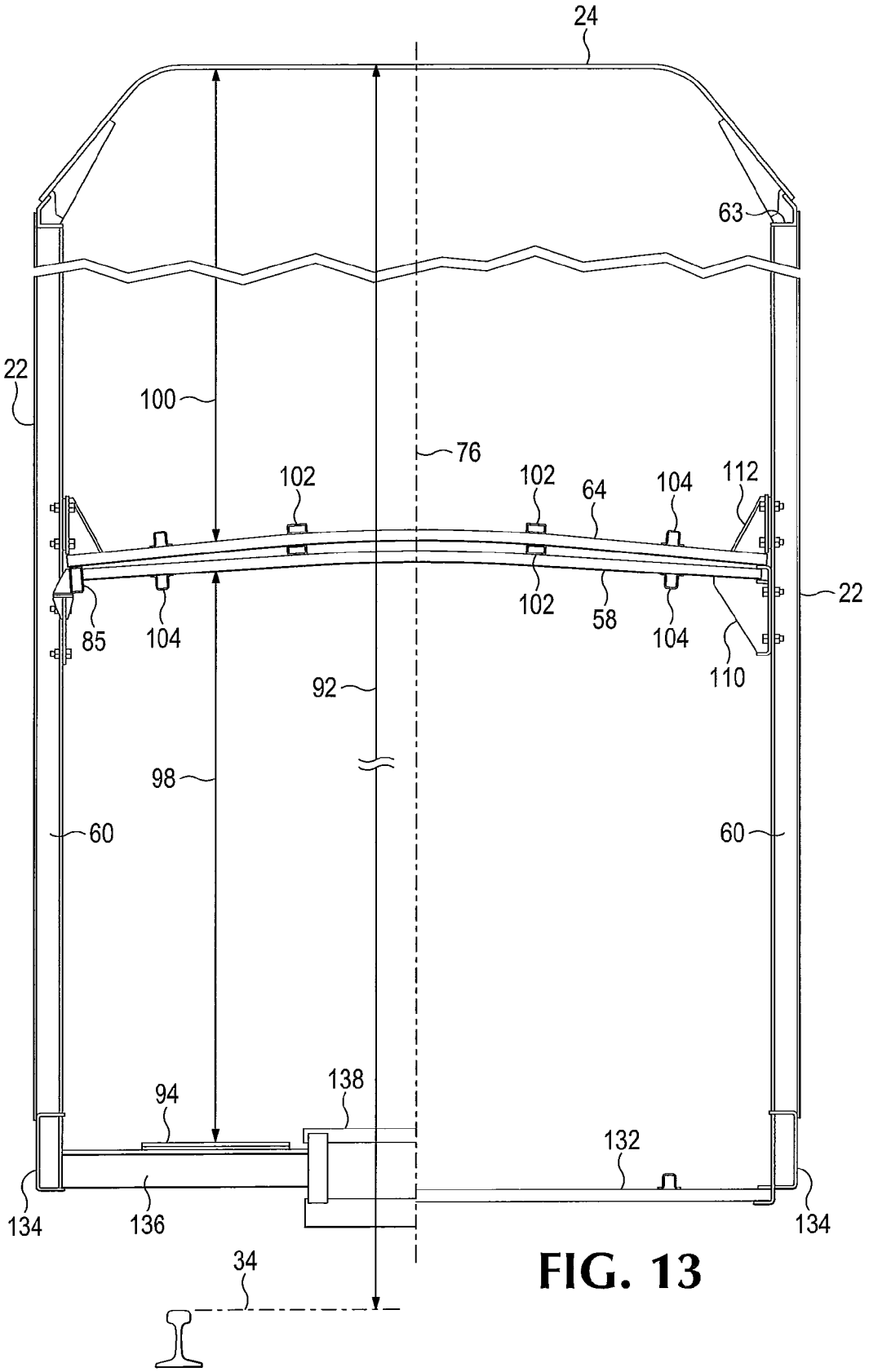
FIG. 13 is a partially cutaway view similar to FIG. 12, but showing the car in a bi-level configuration in which a pair of vehicle-carrying decks have been placed closely adjacent to each other, showing the car at the same two points along the length of the car as in FIG. 12.

In a slightly different motor vehicle-carrying railcar 130 shown in FIGS. 11, 12, and 13, a somewhat different underbody 131 may include a bottom vehicle-carrying deck 132 with the same profile as that in the automobile carrying railcar 16. In the railcar 130 the bottom vehicle-carrying deck 132, instead of being supported atop a dropped center sill, is supported by a pair of deep side sills 134, which may be box beams of ample strength extending along the length of the car between opposite end sills 136.

In each of the opposite end portions 32' of the car 130 there is a draft gear housing 138 similar to that in the previously described car 16, and ramps 70 and 94 may be provided atop the bottom vehicle-carrying deck 132. The top surfaces of the ramps 70 and 94 provide the required heights above the TOR 34 for attachment of a bridge to extend to an adjacent railcar or a loading dock, depending on whether the railcar 130 is in a tri-level or a bi-level configuration as described above with respect to the railcar 16.

The superstructure, including side walls 22, side posts 60 and moveable intermediate and upper decks 58, 64 may be similar to those of the previously described car 16, although the roof 24 and a structure supporting the roof 24 may be somewhat different, and the side posts 60 are connected with the side sills 134.

While many motor vehicle-carrying railcars are made in the form of an auto rack superstructure added to an underbody 18 in the form of a more or less standard low level flat car with a length of 90 feet over strikers, the car 130 shown herein may be built expressly to be a motor vehicle-carrying car as shown. The bottom vehicle-carrying deck 132 may be constructed of a corrugated sheet steel construction utilizing relatively high-strength steel with transversely extending corrugations making the deck self-supporting, with the deck having a thickness of about 1.75 inches. The profile of the bottom deck 132 may be the same as that of the bottom vehicle-carrying deck 46, so that its top surface has a height 133 of 3 feet, 1⅞ inch above the TOR 34 at the end sill 50. Accordingly there may be ramps 94 for bringing the upper surface of the end of the bottom vehicle-carrying deck 132 into agreement with the prescribed height above TOR 34 for the car 130 in the bi-level configuration. There may also be ramps 70 to provide the specified height to mate with bridge structures between the end portions of the car and an adjacent car or loading dock with the car 130 in the tri-level configuration.

Figure 14:
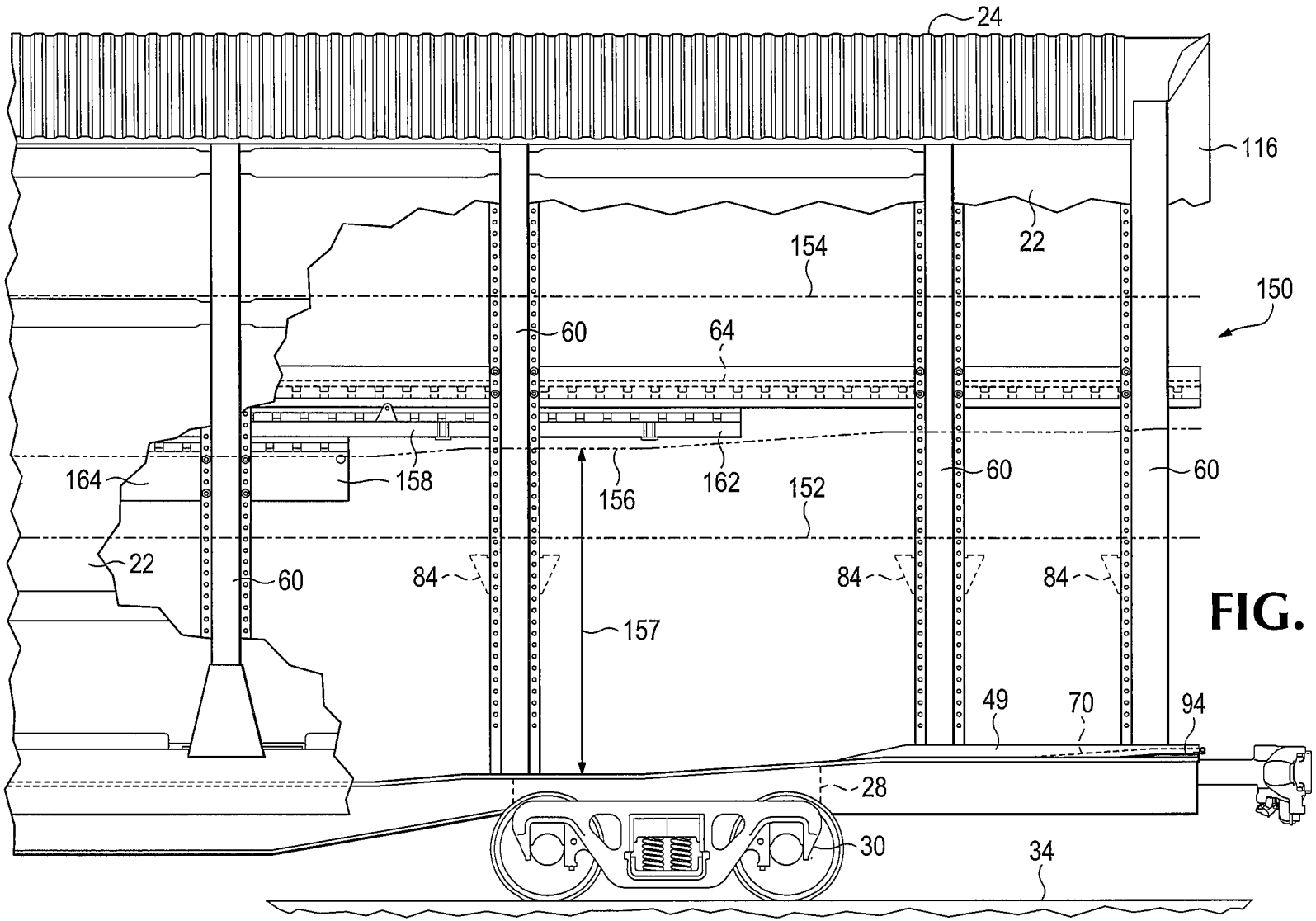
FIG. 14 is a partially cutaway side elevational view of a portion of a railroad car that is a different embodiment of the present invention.
Figure 15:
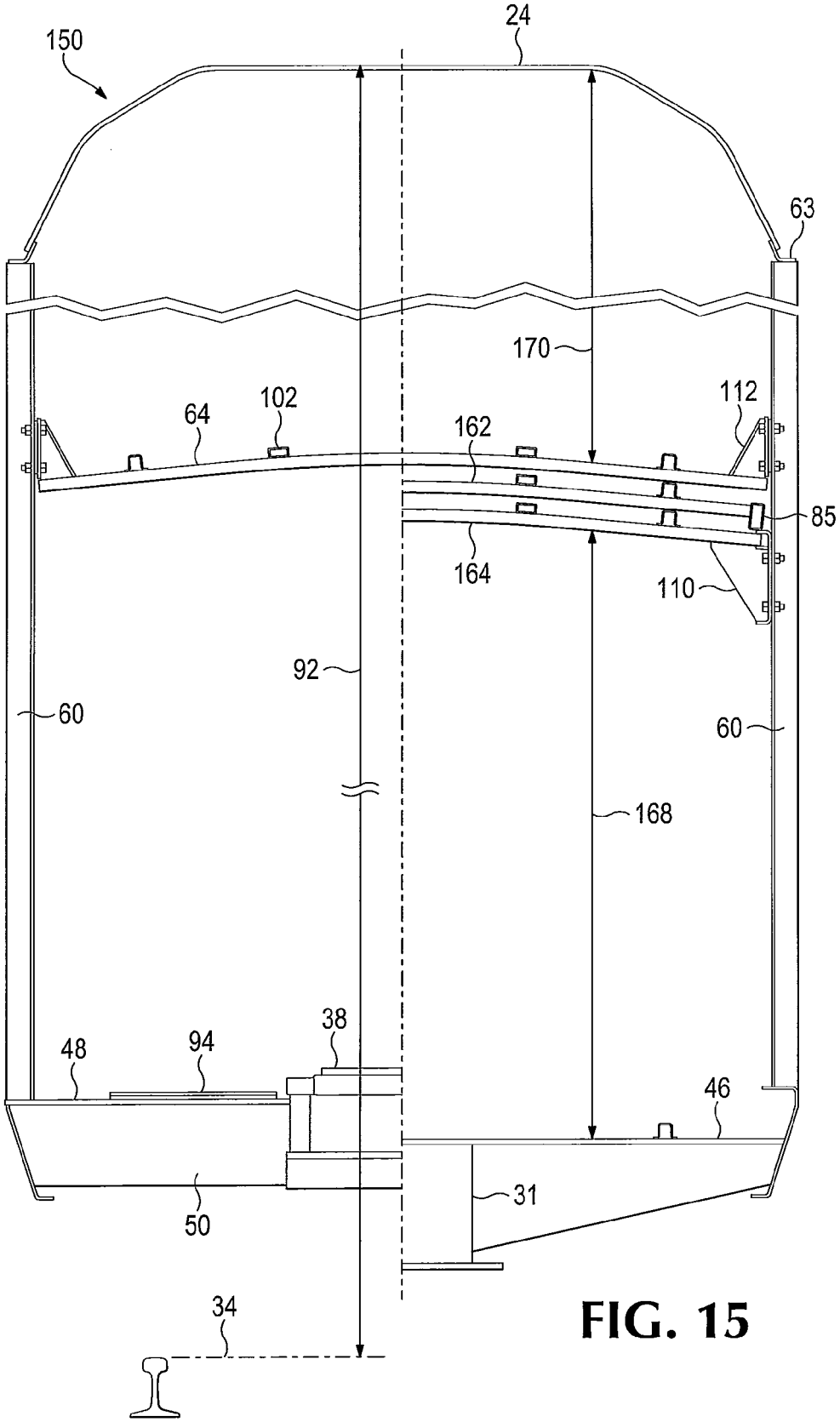
FIG. 15 is an end elevational view, partially foreshortened in height, of the railroad car shown in FIG. 14, showing the configuration at two different points along the length of the car, with the car in a bi-level configuration.

FIGS. 14 and 15 show a motor vehicle-carrying railcar 150 which is similar in many respects to the railcar 16 shown in FIGS. 1-10. The same reference numerals used in FIGS. 1-10 are used in FIGS. 14 and 15 to indicate similar portions of the railcar 150. As shown in FIGS. 14 and 15, the railcar 150 is in a bi-level configuration.

As shown the railcar 150 includes a drop center sill 31 in its underbody 18. It should be understood, however, that the underbody of the railcar 150 could also be of the same construction as in the railcar 130 shown in FIGS. 11, 12, and 13, including a pair of deep side sills 134 instead of the drop center sill 31 shown in FIGS. 14 and 15.

In the tri-level configuration the railcar 150 has its movable intermediate vehicle-carrying deck 158 and its upper vehicle-carrying deck 64 in respective locations substantially similar to the locations of the intermediate vehicle-carrying deck 58 and upper vehicle-carrying deck 64 shown in FIG. 2. In FIG. 14 broken lines 152 and 154 show, respectively, the locations where an intermediate vehicle-carrying deck 158 and the upper vehicle-carrying deck 64 would be when the railcar 150 is in a tri-level configuration similar to that shown in FIGS. 2 and 11. Broken line 156 represents an imaginary surface parallel with the upper surface of the bottom deck 46 and the upper or wheel-supporting surface 72 of the ramp 70, at a distance 157 above the bottom vehicle-carrying deck 46. The distance 157 is 89¼ inches, and thus is greater than the minimum vertical clearance distance required by the American Associate of Railroads, above the bottom vehicle-carrying deck 46 for a motor vehicle-carrying railcar in a bi-level configuration.

An end portion 162 of the intermediate vehicle-carrying deck 158 is interconnected with a mid-length portion 164 by a hinge (not shown), in a manner similar to that of the interconnection between the end portion 82 and the mid length portion of the intermediate vehicle-carrying deck 58 as shown in FIG. 2, so that the end portion 162 may be raised, pivoting about the hinge, to a position similar to that of the end portion 82 as shown in FIG. 2, during loading of motor vehicles into the railcar 150 when it is in its tri-level configuration.

When it is desired to convert the railcar 150 from its tri-level configuration to the bi-level configuration shown in FIGS. 14 and 15, the hinge connecting the end portion 162 with the mid-length portion 164 of the intermediate vehicle-carrying deck 158 is disconnected, and, while the mid-length portion 164 remains temporarily in its position indicated by the broken line 152 in FIG. 14 for the tri-level configuration of the railcar 150, the end portion 162 is raised and moved longitudinally toward the middle of the length of the car, along the top of the mid-length portion 164 of the intermediate vehicle-carrying deck 158. For example, the end portion 162 may be moved a distance of about 10 feet longitudinally along the mid-length portion 164. Movement of the end portion 162 above and along the mid-length portion 164 may be accomplished using various methods and various means of easing the movement, none of which are of particular relevance to the present disclosure, but the end portion 162 must be moved far enough inward, toward the center of the length of the railcar 150, to leave ample vertical clearance distance between the bottom vehicle-carrying deck 46 and the bottom of the intermediate vehicle-carrying deck 158 once the intermediate vehicle-carrying deck is raised to the position shown in FIGS. 14 and 15. The upper vehicle-carrying deck 64 is lowered, and the intermediate vehicle-carrying deck 158 is raised, to the respective positions shown in FIGS. 14 and 15, with part of the end portion 162 remaining between the upper vehicle-carrying deck 64 and the mid-length portion 164.

As may be seen in the right hand portion of FIG. 15, the camber of the intermediate vehicle-carrying deck 158, including its end portion 162, may be the same as the camber of the upper vehicle-carrying deck 64, and because the top surface of the bottom vehicle-carrying deck 46 is lower at a point 166 along the length of the railcar 150 between the body bolsters 28, the vertical clearance 168, between the bottom vehicle-carrying deck 46 and the underside of the mid-length portion 164 of the intermediate vehicle-carrying deck 158, is greater than the minimum specified for a motor vehicle-carrying railcar in a bi-level configuration. At the same time, the clearance 170 above the upper vehicle-carrying deck 64 remains ample and equivalent to the clearance 100 in the railcar 16.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

I claim:

1. An auto rack railcar convertible between a bi-level configuration and a tri-level configuration, comprising:

(a) a flat car having a pair of opposite sides and having a respective draft gear housing at each of a pair of opposite ends;

(b) a bottom vehicle-carrying deck having a portion located alongside each said draft gear housing on each lateral side thereof, a portion of said bottom vehicle-carrying deck adjacent each end of said flat car having a first height and a portion of said bottom vehicle-carrying deck in a mid-length portion of said flat car having a second height that is lower than said first height;

(c) a pair of longitudinally-extending upright opposite side wall assemblies, each including a respective plurality of upstanding side posts supported by and extending upward from a respective opposite side of said flat car;

(d) a roof assembly supported by said side wall assemblies and extending laterally across said auto rack railcar between said side wall assemblies;

(e) an upper vehicle-carrying deck attached to said side posts in a selected one of a location defined by a bi-level configuration and a location defined by a tri-level configuration of said auto rack railcar; and (f) an intermediate vehicle-carrying deck attached to said side posts in a selected one of a location defined by said bi-level configuration and a location defined by said tri-level configuration, said intermediate vehicle-carrying deck including a mid-length portion and an end portion interconnected with the mid-length portion and movable to a raised, inclined position providing a predetermined increased clearance beneath said end portion at one of said ends of said auto rack railcar when said railcar is in said tri-level configuration, said end portion being disconnected from said mid-length portion and moved longitudinally of said mid-length portion, and a part of said end portion being located between said mid-length portion and said upper vehicle-carrying deck when said auto rack railcar is converted to said bi-level configuration.

2. The auto rack railcar of claim 1 including a ramp located alongside said draft gear housing and having an upper vehicle wheel-supporting surface located at a prescribed height above TOR, said prescribed height being lower than a height of an upper surface of said draft gear housing, said auto rack railcar having a prescribed clearance above said upper vehicle wheel-supporting surface and below said intermediate vehicle-carrying deck when said railcar is in said tri-level configuration, and said auto rack railcar having an overall height no greater than 19 feet.

3. An auto rack railcar, comprising:

(a) an underbody including a draft gear housing at a first end of the railcar, the draft gear housing extending longitudinally with respect to the underbody over a first distance from the first end of the car and having a top surface located at a first height above TOR and having a pair of opposite lateral sides;

(b) a bottom vehicle-carrying deck having a car end portion which extends alongside at least a portion of said draft gear housing along each of said lateral sides thereof;

(c) a superstructure carried on said underbody and extending upwardly therefrom, the superstructure including a plurality of upstanding side posts and an intermediate vehicle-carrying deck and an upper vehicle-carrying deck each attached to and supported by the side posts with said auto rack railcar in each one of at least two available configurations including a bi-level configuration and a tri-level configuration, and said car being convertible between said available configurations without removing either of said intermediate and upper vehicle-carrying decks, said intermediate vehicle-carrying deck and said upper vehicle-carrying deck being located closely adjacent each other when said auto rack railcar is in said bi-level configuration, and each of said intermediate vehicle-carrying deck and said upper vehicle-carrying deck having a respective camber, said camber of said intermediate vehicle-carrying deck having a radius of curvature in a transverse plane with respect to said auto rack car that is greater than a radius of curvature of the camber of said upper vehicle-carrying deck;

(d) a roof included in the superstructure and supported by the side posts and defining an overall car height above TOR; and wherein (e) when the auto rack railcar is in the tri-level configuration there are a pair of ramps, each one of said pair of ramps being located on said bottom vehicle-carrying deck, alongside a respective one of said lateral sides of said draft gear housing, each one of said pair of ramps having a respective upper wheel-supporting surface located at a ramp top height that is lower than said first height, and wherein there is at least a predetermined first vertical clearance height between each of said upper wheel-supporting surfaces and a bottom surface of said intermediate vehicle-carrying deck; and wherein (f) when said auto rack railcar is in said bi-level configuration said bottom surface of said intermediate vehicle-carrying deck is located at a greater height than when said auto rack railcar is in said tri-level configuration, and there is at least a predetermined second vertical clearance height between each of said upper wheel supporting surfaces and said bottom surface of said intermediate vehicle-carrying deck.

4. The auto rack railcar of claim 3 wherein said underbody has a pair of body bolsters and a pair of deep side sills extending between said pair of body bolsters and wherein a portion of said bottom vehicle-carrying deck between said body bolsters is located between said side sills and at a lower height than a height of said car end portion of said bottom vehicle-carrying deck.

5. An auto rack railcar, comprising:

(a) an underbody including a draft gear housing at a first end of the railcar, the draft gear housing extending longitudinally with respect to the underbody over a first distance from the first end of the car and having a top surface located at a first height above TOR and having a pair of opposite lateral sides;

(b) a bottom vehicle-carrying deck having a car end portion which extends alongside at least a portion of said draft gear housing along each of said lateral sides thereof;

(c) a superstructure carried on said underbody and extending upwardly therefrom, the superstructure including a plurality of upstanding side posts and an intermediate vehicle-carrying deck and an upper vehicle-carrying deck each attached to and supported by the side posts with said auto rack railcar in each one of at least two available configurations including a bi-level configuration and a tri-level configuration and said car being convertible between said available configurations without removing either of said intermediate and upper vehicle-carrying decks;

(d) a roof included in the superstructure and supported by the side posts and defining an overall car height above TOR; and wherein (e) when the auto rack railcar is in the tri-level configuration there are a pair of ramps, each one of said pair of ramps being located on said bottom vehicle-carrying deck, alongside a respective one of said lateral sides of said draft gear housing, each one of said pair of ramps having a respective upper wheel-supporting surface located at a ramp top height that is lower than said first height, and wherein there is at least a predetermined first vertical clearance height of at least 54 inches between each of said upper wheel-supporting surfaces and a bottom surface of said intermediate vehicle-carrying deck and wherein there is a predetermined vertical clearance height of at least about 61⅞ inches between each of said upper wheel supporting surfaces of said intermediate vehicle-carrying deck and said bottom surface of said upper vehicle-carrying deck, and wherein there is at least about 65⅝ inches vertical clearance above a vehicle wheel-supporting surface of said upper vehicle-carrying deck within said auto rack railcar and beneath said roof, and wherein the roof defines an overall height no greater than 19 feet; and wherein (f) when said auto rack railcar is in said bi-level configuration said bottom surface of said intermediate vehicle-carrying deck is located at a greater height than when said auto rack railcar is in said tri-level configuration, and there is at least a predetermined second vertical clearance height between each of said upper wheel supporting surfaces and said bottom surface of said intermediate vehicle-carrying deck.

6. The auto rack railcar of claim 5 wherein said upper wheel supporting surface of one of said pair of ramps is located at a height within a range of 37½ inches to 43½ inches above the TOR at a location adjacent said end of said railcar when said railcar is in said tri-level configuration.

7. The auto rack railcar of claim 5 wherein said car end portion of said bottom vehicle-carrying deck is at a second height that is lower than said first height.

* * * * *